United States Patent [19]

Thompson et al.

[11] Patent Number: 4,676,138

[45] Date of Patent: Jun. 30, 1987

[54] GUN-POWERED LINEAR LINKLESS AMMUNITION MAGAZINE

[75] Inventors: William W. Thompson; Lawrence D. Bacon, both of Fountain Valley; Kent G. Curry, Long Beach; Steve Morihiro, Fountain Valley, all of Calif.

[73] Assignee: Western Design Corporation, Irvine, Calif.

[21] Appl. No.: 836,114

[22] Filed: Mar. 4, 1986

[51] Int. Cl.[4] ..... F41D 10/14

[52] U.S. Cl. ..... 89/33.14; 89/33.5; 89/34; 89/35.01

[58] Field of Search ..... 89/33.01, 33.1, 33.14, 89/33.16, 33.2, 33.25, 33.5, 34, 35.01

[56] References Cited

U.S. PATENT DOCUMENTS

| | | | |
|---|---|---|---|
| 681,439 | 8/1901 | Carr | 89/33.02 |
| 723,719 | 3/1903 | North | 89/33.02 |
| 1,256,924 | 2/1918 | Nelson | 89/33.02 |
| 1,629,652 | 5/1927 | Browning | 89/33.02 |
| 1,747,546 | 2/1930 | Janecek | 89/33.02 |
| 2,394,606 | 2/1946 | Gazda | 89/33.02 |
| 2,407,461 | 9/1946 | Vesely | 89/33.02 |
| 2,974,569 | 3/1961 | Cross | 89/33.2 |
| 4,524,673 | 6/1985 | Golden | 89/33.02 |

FOREIGN PATENT DOCUMENTS

| | | | |
|---|---|---|---|
| 2624 | of 1892 | United Kingdom | 89/33.1 |
| 10622 | of 1907 | United Kingdom | 89/33.02 |

*Primary Examiner*—Stephen C. Bentley

*Attorney, Agent, or Firm*—Walter A. Hackler

[57] ABSTRACT

An ammunition magazine for small arm weapons having a reciprocating bolt and an ammunition feedwell therein includes a housing for storing a plurality of ammunition rounds and a drive spring for urging the ammunition rounds out of the housing. In addition, a feeder is provided for passing the ammunition rounds from the housing into the ammunition feedwell of the small arm weapon. The feeder is configured for being removably inserted into the small arm weapon ammunition feedwell and includes a feeder spring for urging ammunition rounds along the feeder from the ammunition housing and within the ammunition feedwell. An impact system is provided for engaging the reciprocating bolt of the small arm weapon and causing movement of the reciprocating bolt to compress both the drive spring and the feeder spring.

29 Claims, 6 Drawing Figures

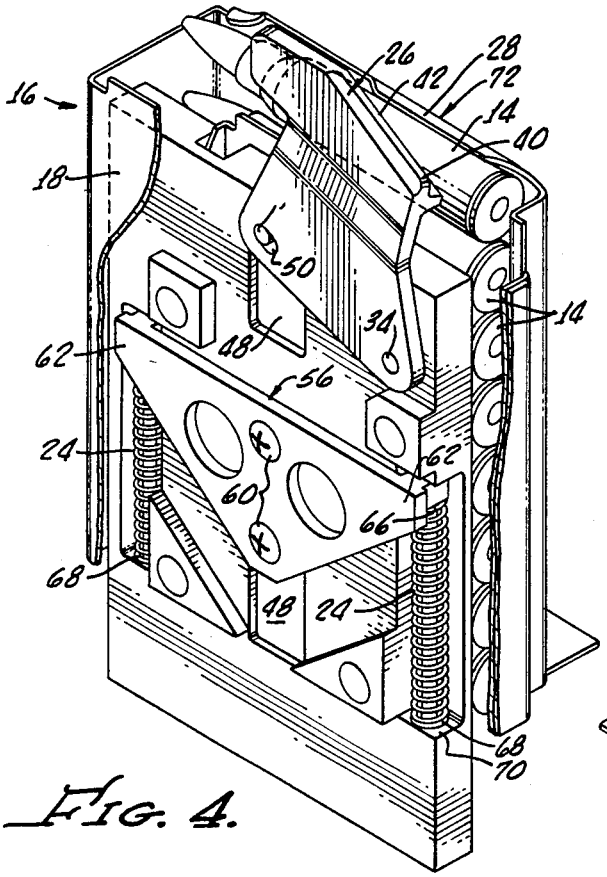
FIG. 4.
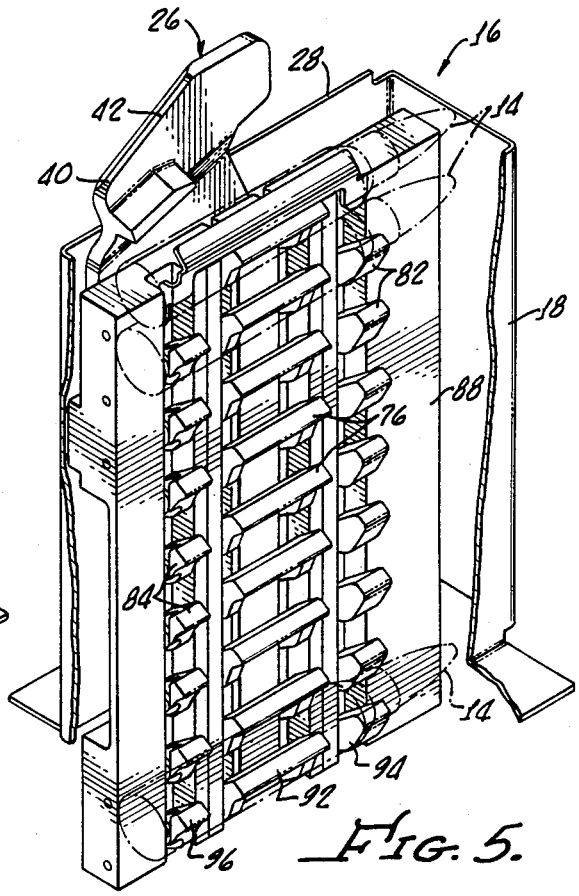
FIG. 5.
FIG. 6.
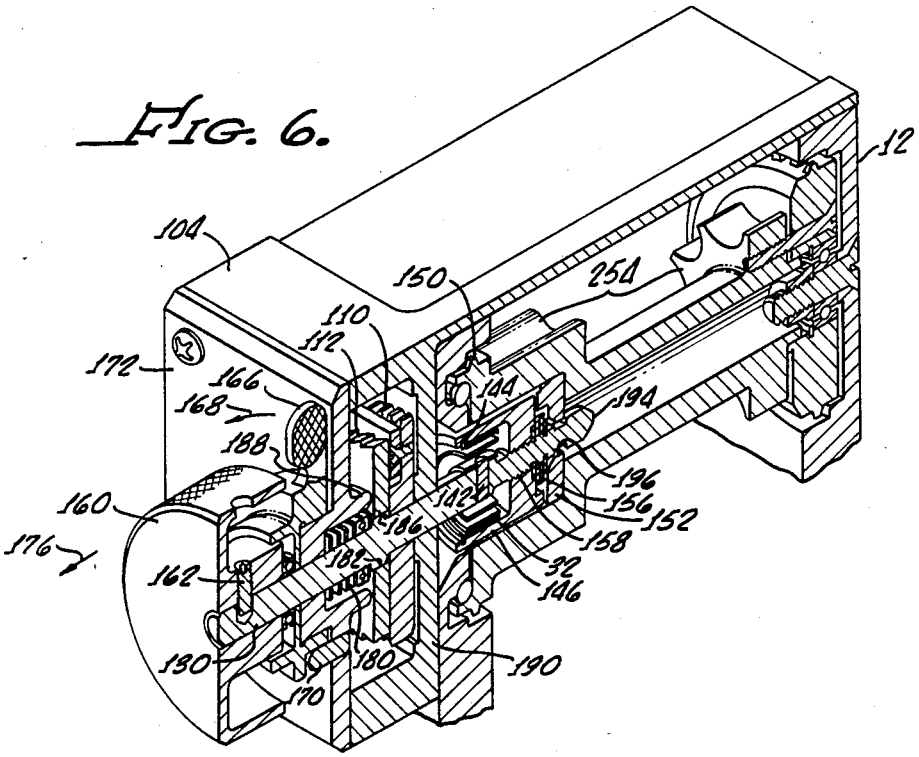

GUN-POWERED LINEAR LINKLESS AMMUNITION MAGAZINE

The present invention is directed to an ammunition magazine for hand-held weapons, such as sporting and self-defense rifles, carbines, assault rifles, sub-machine guns, and light-to-medium machine guns, and the like.

More particularly, the present invention is directed to an ammunition magazine and ammunition magazine system which utilizes power from the hand-held weapon to drive ammunition rounds into the ammunition feedwell of the weapon.

A number of ammunition magazines and magazine systems have been developed for hand-held weapons.

As generally described in U.S. Pat. No. 4,524,673, issued June 25, 1985, entitled "GUN-POWERED AMMUNITION MAGAZINE", ammunition storage and feed systems for small arm weapons have generally included "clip", "linked belt", and "spring-powered" type magazines.

Clip type magazines have been in wide use since they are inexpensive, and for many applications hold a satisfactory number of ammunition rounds.

However, their capacity is limited to approximately 30 rounds or less. This limitation is imposed by the spring utilized therein for urging ammunition rounds toward an exit port in the magazine housing. Increased capacity of the magazine requires either higher spring preloads or higher spring travel, or both.

Hence, it has been found for magazines in excess of 30 rounds, premature spring fatigue is likely. When this occurs, magazine induced gun failure, such as jamming or failure to feed an ammunition round into proper position, may occur.

The storage of loaded magazines for long periods of time causes the springs therein to be compressed, and this condition may accelerate premature spring fatigue.

Because a magazine spring must physically urge a large number of ammunition rounds within the magazine housing and to a pickup point within the gun, firing rates for weapons utilizing clip type magazines are generally limited to less than 600 rounds per minute.

Linked belt feeders, however, are well suited for providing ammunition fast enough to sustain high weapon firing rates.

Although they theoretically have an unlimited ammunition capacity, linked belt feeders are relatively expensive compared to the clip-type ammunition magazines and, since they are usually heavy, they are best suited for use with a gun firing from a fixed position and hence, ideally suited for medium-to-heavy machine gun systems.

Other spring-type ammunition magazines typically utilize a circular-type spring to eliminate the spring travel problems of the clip-type ammunition magazine.

While these magazines may have a better capacity than the clip-type magazines, they are still subject to premature drive-spring failure. In an effort to reduce spring fatigue during storage, many of these ammunition magazines may be stored with the spring unwound. Hence, the magazine is not operational until wound by a gunner, and this introduces a further complication in its infield use.

U.S. Pat. No. 4,524,673 hereinbefore-referenced describes another class of ammunication magazines in which energy is taken from the gun reciprocating bolt to move ammunition rounds within the magazine housing toward an exit port and into a position for pickup by the reciprocating bolt. This type of magazine system employs a modest spring to buffer power input from the gun.

This has significant advantage in that the size of spring in relation to the number of rounds stored by the magazine is significantly reduced.

In addition, since the spring utilized is not overly compressed, the problems of spring fatigue are significantly reduced with concomitant reduction in gun malfunction.

The specific embodiment disclosed in this reference utilizes a cam for engaging the bolt and causing movement of the bolt to wind a spring within the magazine.

While having wide application for many weapons, this cam drive system is not suited for use with certain guns, such as the M16, which has limited excess bolt energy in counter-recoil.

The present invention overcomes the shortcomings utilizing an impact system for extracting energy from the reciprocating bolt. The impact system of the present invention does not suffer as much frictional loss as the continuous velocity cam system of U.S. Pat. No. 4,524,673.

SUMMARY OF THE INVENTION

An ammunition magazine, in accordance with the present invention, for small arm weapons having a reciprocating bolt and an ammunition feedwell therein, includes a housing for storing a plurality of ammunition rounds and a feeder for passing the ammunition rounds from the housing into the ammunition feedwell of the small arm weapons.

Drive spring means are provided for urging ammunition rounds out of the housing with the drive spring means decompressing as the ammunition rounds are urged out of the housing.

The feeder is configured for being removably inserted into the small arm weapon ammunition feedwell and includes feeder spring means for urging the ammunition rounds along the feeder means and within ammunition feedwell of the small arm weapon. The feeder spring means also decompress as the ammunition rounds are moved within the ammunition feedwell.

Means are provided which communicate with both the drive spring means and the feeder spring means for engaging the reciprocating bolt and causing movement of the reciprocating bolt to compress both the drive spring means and the feeder spring means when the feeder spring means is inserted into the small arm weapon ammunition feedwell.

The feeder includes a set of stationary pawls and a set of movable pawls for moving ammunition rounds with the movable pawls being driven by a linear type spring.

More particularly, the means for engaging the reciprocating bolt includes an impact arm extending outwardly from the feeder housing for engaging the reciprocating bolt. The impact arm is interconnected with the pawl carrier for compressing the feeder spring means. The magazine housing includes a pair of end plates with a plurality of sprockets disposed therebetween for supporting a continuous ammunition conveyor strip. The ammunition is held within the housing in a generally parallel relationship with one another and the small arm weapon reciprocating bolt.

The sprockets are disposed within the housing means for supporting the ammunition conveyor, and the ammunition, in a serpentine fashion within the magazine housing means. This feature enables a large number of ammunition rounds to be supported within a particular housing volume.

To further increase the ammunition capacity of the housing without causing it to be so long as to interfere with the gunner's operation of the gun, the end plates and the ammunition housing have an overall shape of a yoke, having two branches with a crotch therebetween.

The feeder means is removably attached to the housing means at the crotch thereof so that the two branches extend toward the small arm weapon when the feeder means is inserted into the small arm weapon ammunition feedwell.

In addition, the drive spring means, in accordance with the present invention, includes winder-buffer means for converting linear motion of the pawl carrier into rotary motion to turn a drive sprocket for moving the ammunition conveyor strip, said winder/buffer means including a coiled clock-type spring for buffering between the relatively high speed acceleration start/-stop motion of the pawl carrier and the relatively low speed/acceleration movement of the drive sprocket and ammunition conveyor.

Importantly, in accordance with the present invention, the feeder and the housing are configured for in-field coupling and uncoupling from one another.

Hence, there is provided an ammunition magazine system, in accordance with the present invention, which includes a plurality of magazine housings, with each magazine housing being adapted for storing a plurality of ammunition rounds.

A feeder is provided which is configured for being removably inserted to the ammunition feedwell of a small arm weapon and further configured for being removably coupled with any one of the plurality of magazine housings.

This feature enables rapid exchange of housings with the feeder installed in the gun ammunition feedwell. Additionally, the overall cost of the system is reduced since a feeder need not be attached to each housing.

Further, the overall volume required to store a given amount of ammunition is reduced because the feeders need not be stored with the housings.

As hereinabove-described, the feeder has spring means for urging the ammunition rounds along the feeder within the ammunition feedwell of the small arm weapon, with the feeder spring decompressing as the ammunition rounds are moved within the ammunition feedwell. Additionally, the feeder includes drive spring means adapted for interconnection with each one of said magazine housings for urging ammunition rounds out of the housing with which it is interconnected.

The feeder has means communicating with the feeder spring means and the drive spring when the feeder is coupled to one of the plurality of magazine housing, with this last mention means being operative for engaging the reciprocating bolt and causing movement of the reciprocating bolt to compress the feeder spring and the drive spring when the feeder is inserted into the small arm weapon of the feedwell and coupled to one of the plurality of housing means.

BRIEF DESCRIPTION OF THE DRAWINGS

The foregoing and other features and advantages of the present invention will be apparent in the following description taken in conjunction with the accompanying drawings in which:

FIG. 4 is a perspective view of the feed tower showing a pawl carrier and a carrier link interconnecting the carrier link with a pair of linear feeder springs;

FIG. 5 is a perspective view of the feed tower showing the set of stationary pawls and a set of moving pawls; and, FIG. 6 is a perspective view, in-cross section, of a winder-buffer sub-assembly showing its engagement with the housing.

DETAILED DESCRIPTION OF THE INVENTION

Figure 1:
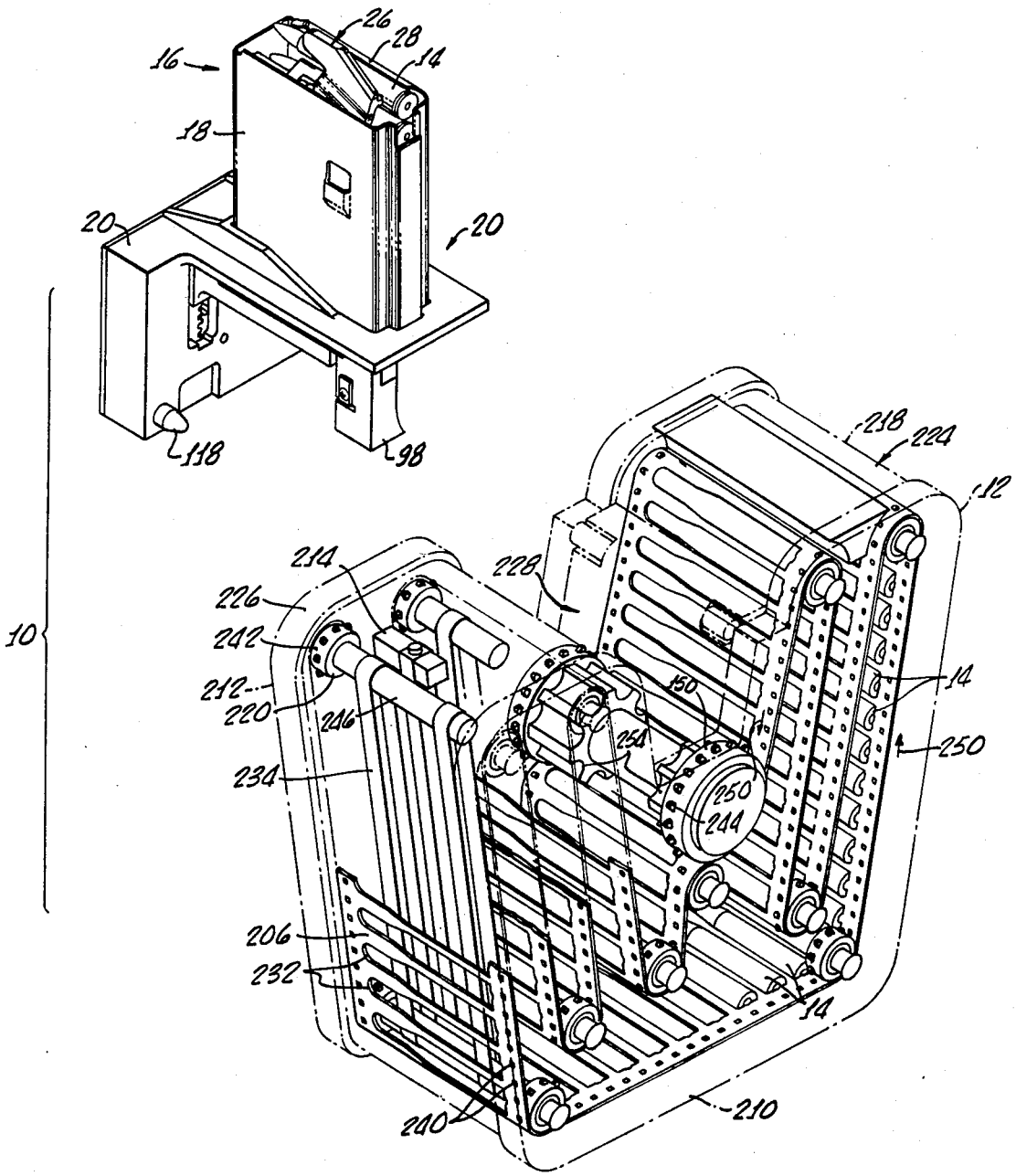
FIG. 1 is an exploded perspective view of a magazine system, in accordance with the present invention, generally showing a housing and a feeder assembly, the feeder assembly and housing being shown separated from one another to illustrate the decoupling features of the magazine system.

Turning now to FIG. 1 there is an ammunition magazine 10 in accordance with the present invention generally showing a housing 12 which provides means for storing a plurality of ammunition rounds 14, and a feeder assembly 16, which provides means for passing the ammunition rounds 14 from the housing 12 and into an ammunition feedwell (not shown) of a small arm weapon.

Figure 2:
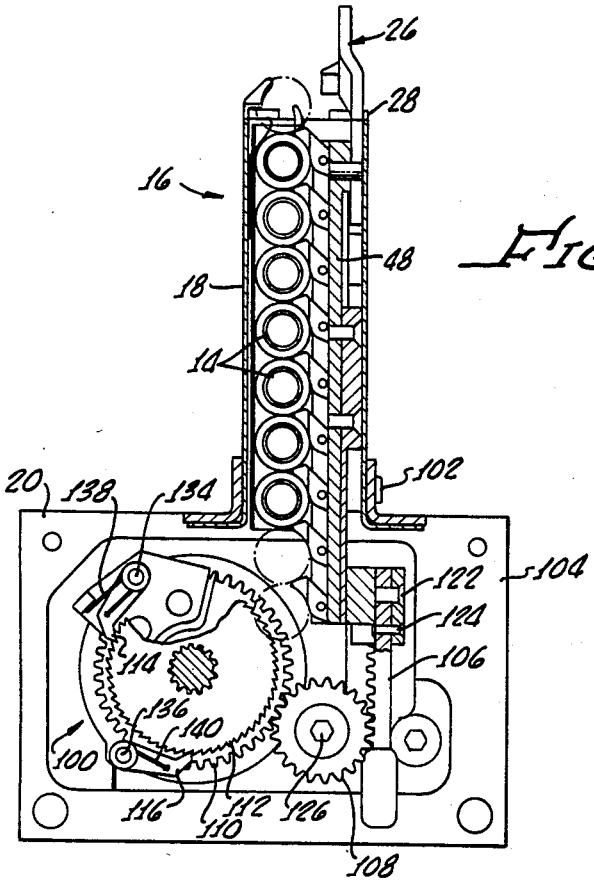
FIG. 2 is a cross-sectional view of the feeder showing a feed tower with a pawl carrier therein and a winder-buffer sub-assembly.
Figure 3:
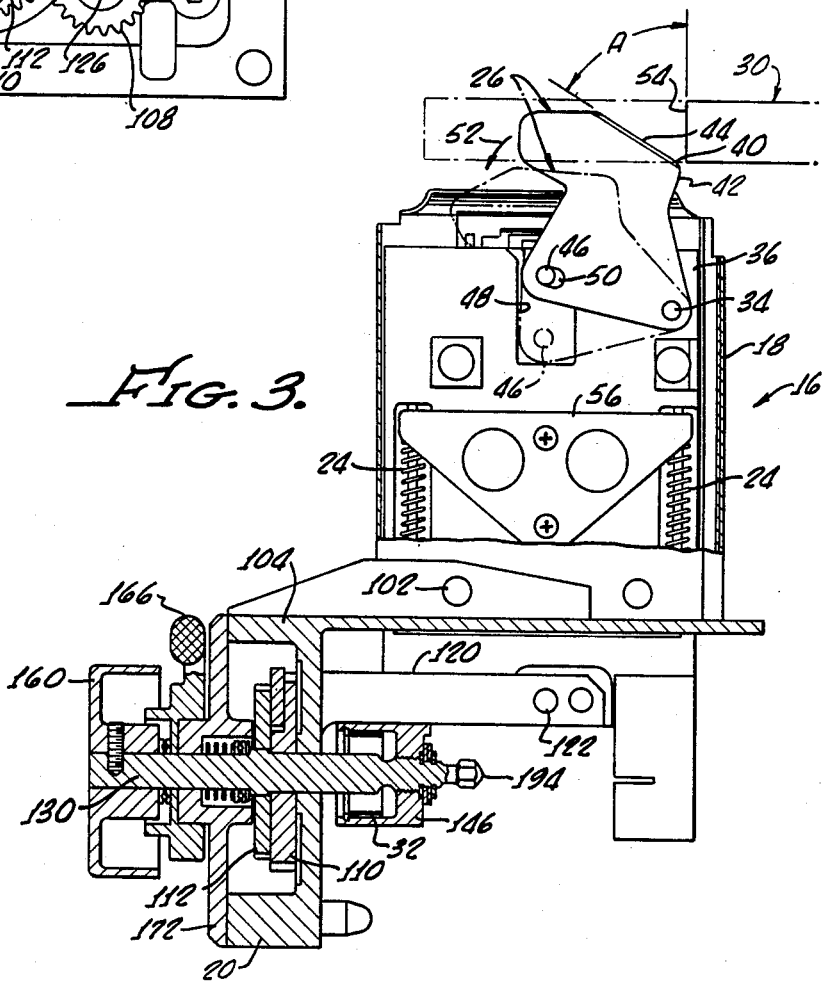
FIG. 3 is a cross-section of the feeder assembly taken in a side elevation.

More clearly shown in FIGS. 2 and 3, the feeder assembly 16 includes a feed tower 18 and a winder-buffer sub-assembly 20. Having a preselected width and length, the tower 18 is configured for being removably inserted into the small arm weapon ammunition feedwell. In particular, a preferred embodiment of the present invention is configured for insertion into a standard M-16 weapon.

As will be hereinafter discussed in greater detail, the feeder assembly 16 includes a pair of feeder springs 24, which provides means for urging ammunition rounds 14 along the feed tower 18 and within the ammunition feedwell of the small arm weapon (not shown).

An impact arm 26 extends outwardly from a top 28 of the feed tower 18 and is positioned for engagement with a small arm weapon reciprocating bolt 30 when the feed tower 18 is inserted into the small arm magazine feedwell. (FIG. 3). In a preferred embodiment which is configured for use with an M-16 type weapon, the impact arm is configured, as hereinafter described, for being driven, or shoved away, from the bolt 30 upon impact (impact system) thereof rather than camming or being pushed by the bolt (continuous velocity system). While the continuous velocity system (not shown) may be suitable for some weapons, the preferred impact system of the present invention has been found to be best suited for the M-16 because of the limited amount of energy available in the counter-recoiling M-16 bolt.

As will be hereinafter discussed in greater detail, the impact arm is interconnected with the feeder springs 24 and a torsional drive spring 32 disposed in the winder buffer assembly 20 (FIG. 3).

As shown in FIG. 3, the impact arm 26 is pivotally mounted by means of a pin 34 to a frame member 36 to enable rotation of the impact arm about the pin 34 upon impact of the reciprocating bolt 30.

The pin 34 and pivot point of the impact arm 26 is located directly beneath an initial impact point 40 at an end 42 along a face 44 of the impact arm 26. At a point spaced apart from the pivot pin 34, the impact arm is pin 46 mounted to a pawl carrier 48 with the pin 46 riding in a slot 50 to enable movement therein as the impact arm 26 is pivoted in the direction of arrow 52 about the pin 34 by the reciprocating bolt 30.

The impact at the point 40 with respect to a bolt face 54 is selected so that engagement of the bolt face occurs abruptly without any substantial sliding on the impact arm face 44. This causes rapid rotation of the impact arm about the pivot pin 34 without continued engagement of the bolt with the face 42 of the impact arm 26.

The angular relationship "A" between the impact arm face 42 and the bolt face 54 may be selected to avoid subsequent contact between the bolt 30 and the impact arm face 44.

It is important to recognize that this preferred impact system is distinctly different from prior art camming systems in which a cam and a bolt remain in contact with one another as the bolt moves forward during operation of the gun. This arrangement has considerably increased frictional loss as the result of this continuous velocity cam system.

In order to return the impact arm 26 to its original position after the bolt 30 has again recoiled, it is necessary to store potential energy in the springs 24. The impact system of the present invention is well suited for this since the impact arm 26 has the highest velocity impact and is slowed down by the springs 24.

In contrast, a continuous velocity cam system starts at zero velocity and thereafter accelerates. This results in spring compression in an accelerated manner and excess kinetic energy available at the end of the compression stroke is not utilized by the cam system.

Attached to the pawl carrier 48 is a carrier link 56 by means of screws 60, or the like, and having portions 62 thereon attached to top portions 66 of the linear springs 24. A bottom portion 68 of the springs 24 engages a bottom plate 70 of a feed tower housing 72.

This interconnection enables the pivotal movement of the impact arm 26 to move the pawl carrier downward and at the same time compress the springs 24.

Attached to the pawl carrier 48 is a set of moving pawls 76. (FIG. 5). These moving pawls are pivotally mounted to the pawl carrier 48 in a conventional manner utilizing biasing springs (not shown) to enable the moving pawls to pass ammunition rounds 14 supported by a set of forward and aft stationary pawls 82, 84 when the moving pawls are moved downward by the pawl carrier 48.

The forward and aft stationary pawls 82, 84 are also pivotally mounted in a conventional manner to a frame member 88 of the feeder 18 with biasing springs (not shown).

It should be apparent that the moving pawls 76 pivot or rotate inwardly toward the pawl carrier 48 when the pawl carrier is moving downward to enable the moving pawls to slide past ammunition rounds.

Upon upward movement of the pawl carrier 48 and moving pawls 76, the ammunition rounds are moved upwardly therewith past the forward and aft stationary pawls 82, 84, which rotate or pivot inwardly toward the frame member 88, enabling the ammunition rounds to slide therepast.

It should also be apparent from FIG. 5 that the lowest moving pawl 92 is moved below the lowest forward and aft stationary pawls 94 and 96 and into a depending housing 98 to engage and lift ammunition rounds 14 from the housing 12.

During movement of the moving pawls 76 upwardly and the feeding of ammunition through the feed tower housing 72, no power is inputted into, or taken out, the drive spring 32 in the winder-buffer assembly 20, because of the ratchet system 100 in the winder-buffer assembly (see FIG. 2).

Turning now to the winder-buffer assembly 20 (FIGS. 2 and 3), it can be seen that the feed tower 18 is secured thereto by screws 102, or the like, to form the feeder assembly 16. The feeder assembly 16 is configured for being removably coupled with the magazine housing 12 by way of the winder-buffer assembly 20 and the combined operation thereof will be hereinafter discussed in greater detail.

Generally, the winder-buffer 20 includes a frame 104, a drive rack 106, spur gear 108, drive gear 110, drive ratchet 112, a drive ratchet pawl 114, a retaining ratchet pawl 116 and locating pins 118 for coupling with the magazine housing 12.

The drive rack 106 is interconnected with the pawl carrier 48 by means of a rack bracket 120 which is screw 122 mounted therewith. The rack bracket 120, which may be attached to the drive rack 106 by means of a screw 124, or the like, moves downwardly with the pawl carrier 48, thus moving the drive rack 106 downwardly and rotating the spur gear 108 about its axis 126.

During operation, the pawl carrier moves down approximately one-half inch during the counter-recoil of the bolt 30 and causes the drive rack 106 to rotate the drive gear 110 approximately 36° by means of the spur gear 108.

The spur gear 108 may be included in the ratchet system 100 to cause the rotation of the drive gear 110 to be in a direction to cause the feeding of rounds 14 upwardly along the feed tower 18 when the bolt is counter-recoiling. The drive gear 110 is bearing mounted on a drive shaft 130 and rotates the drive ratchet 112 through a drive ratchet pawl 114.

This ratchet system 100 operates in a conventional manner to convert the reciprocating vertical motion of the pawl carrier 48 and drive rack 106 into a one-way rotary motion of the drive ratchet 112.

The drive ratchet 112 is splined to the drive shaft 130 thereby causing the drive shaft 130 to rotate approximately 1/10th of a turn for each bolt counter-recoil, and the retaining ratchet pawl 116 prevents backward rotation of the drive ratchet 112.

Both the drive ratchet pawl 114 and retaining ratchet pawl 116 are conventionally mounted on pins 134, 136 and are biased by springs 138, 140 into the drive ratchet 112.

The drive shaft 130 is connected to the inside 142 of the torsional drive spring 32 with the outside 144 of the torsional drive spring 30 being attached to a spring housing 146 (see FIG. 6).

It should be apparent that this arrangement enables the drive spring to buffer between the high acceleration start/stop motion of the drive shaft 130 and the more continuous and gradual spring housing 146 which interfaces with the drive sprocket 150 through a drive ring 152 and a square jaw clutch 156.

The drive shaft may be coupled to the spring housing 146 through a threaded interface 158 and is positioned therein so that if the drive shaft advances more than one full revolution ahead of the spring housing 146, the threaded interface 158 causes the spring housing to move forwardly toward a drive knob 160 and disengage the square jaw clutch 156 between the spring housing 146 and the drive sprocket 150. This allows the drive spring 32 to unwind.

As the drive spring unwinds, the spring housing 146 moves rearwardly away from the drive knob 160 because of the threaded interface 158 and the square jaw clutch reengages the drive sprocket 150.

The square jaw clutch 156 also enables the feeder assembly 16 including the feed tower 18 and the winder-buffer 20 to be separated from the magazine housing 12, as shown in FIG. 1.

A system of a plurality of magazine housings 12 identical to those shown in FIG. 1 and a feeder assembly 16, thus provide for compact storage of individual ammunition rounds in the housings 12 without the need of storing the feeder assembly 16 therewith.

In operation, the feeder assembly 16 is inserted into the ammunition feedwell of a small arms weapon (not shown) and individual housings 12 coupled therewith for passing ammunition 14 from the ammunition housing through the feeder assembly 16 and into the ammunition feedwell of the small arm weapon. When all of the rounds have been withdrawn from one magazine 12, it may be decoupled from the feeder assembly 16 and a full magazine coupled with the feeder assembly. The feeder assembly need not be removed from the weapon ammunition feedwell during this procedure.

Turning to FIG. 6, it can be seen that the drive knob 160 is fixed to the drive shaft 130 by means of a set screw 162, or the like, so that an operator may turn the drive shaft 130, by means of the drive knob, upon rotation of a clutch collar 166 in a direction shown by the arrow 168. The clutch collar 166 may be cammed on three housing pins 170 which are pressed into a forward plate 172 of the winder-buffer frame 104. The housing pins 170 are sized and arranged so that rotating the clutch collar 166 approximately 60° causes the drive shaft 130 to be pulled forwardly along with the drive knob 160 in the direction of arrow 176. A spring 180 is compressed between enlarged portion 182 of the drive shaft 130 during rotation of the clutch collar 166 and forward motion of the drive shaft 130.

Forward motion of the drive shaft causes the square jaw clutch 156 to disengage the drive ring and also disengages the splined interface 186 between the drive ratchet and the drive shaft 130.

Since the drive ratchet 112 is held in position between a protruding portion 188 of the forward plate 172 and a back plate 190 of the winder-buffer frame, the drive shaft 130 moves independently thereof in a laterally direction of the arrow 176, thus disengaging the drive shaft 130 from the drive ratchet 112.

At the same time, a hex-faced end 194 of the drive shaft 130 engages a mating opening 196 in the drive ring 152, which is an integral part of the drive sprocket 150. This engagement enables the drive shaft and the drive sprocket 150 to be rotated clockwise and counter-clockwise by the drive knob 160.

This feature of independent rotation of the drive sprocket 150 within the housing 12 enables manual reloading (uploading), or unloading (downloading), of the housing 12.

Turning now to FIG. 2, it can be seen that the ammunition rounds 14 are disposed within the feeder housing 104 and housing means 12 in a generally parallel relationship with one another by means of an ammunition conveyor strip 206, which may be of any suitable plastic material.

Although a conventional chain ladder system could be used to support the ammunition rounds within the magazine housing 12, the plastic film strip 206 is preferable because it represents a significant gain in cost-effectiveness.

The housing 12, or storage container, includes two end-plates 210, 212, and are held in a spaced-apart relationship by spacers 214 and an exterior sheet metal skin 218. The spacing is appropriate to accommodate both the ammunition rounds 14, the conveyor strip 208 and the drive sprocket 150 and a plurality of idler sprockets 220.

In order to reduce the overall dimensions of the magazine housing 12 and accommodate a large number of rounds without interfering with the operation of the weapon, the end-plates 210, 212, and the ammunition housing 12 has an overall shape in the nature of a yoke having two branches 224, 226 with a crotch 228 therebetween.

The idler sprockets 220 are disposed in a conventional manner for holding the conveyor strip 206 in a serpentine manner within the housing 12. The conveyor strip has individual cutouts 232 for holding ammunition 14 between round guides 234 and the sheet metal skin 218.

Additionally, the conveyor strip 206 includes punched holes 240 for engagement with sprocket teeth 242 on the idler sprockets and sprocket teeth 244 on the drive sprocket 150.

The idler sprockets are conventionally rotatably mounted on shafts 246 mounted between the end-plates 210, 212 of the magazine 12.

Tension of the conveyor strip within the magazine 12 may be achieved in any conventional manner by spring loading or static a pair of the idler sprockets (not shown) within the magazine housing.

During operation, the drive sprocket 150 is rotated by the torsion drive spring 32 which is maintained at proper tension by the charging thereof through the action of the impact arm 26, the threaded interface 158 and square jaw clutch 156. This rotation causes the drive sprocket 150 to move the conveyor strip 206 along with ammunition rounds 14 in a direction shown by the arrows 250 in FIG. 1.

Upon reaching the crotch 228 of the magazine housing 12, the ammunition rounds 14 are passed from the conveyor strip 208 to ammunition handling sprockets 254, which position the ammunition rounds 14 for for enabling pick up by the lowest moving pawl 92 upon its downward movement on the pawl carrier 48 as a result of impact of the impact arm 26 by the bolt 30.

An additional feature of the present invention resides in the fact that separate feeder springs 24 act to urge ammunition rounds along the feed tower 18. Hence, all of the ammunition rounds in both the housing 12 and the feed tower may be fed into the small arm weapon.

Unlike a number of currently available ammunition magazines which cannot completely be emptied because of mechanical interface problems with the small arm weapon, the ammunition magazine 10 of the present invention is efficient in utilizing all ammunition rounds 14 stored in both the magazine housing 12 and the feeder assembly 16.

Although there has been hereinabove-described a particular arrangement of an ammunition magazine, in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. An ammunition magazine for small arm weapons having a reciprocating bolt and an ammunition feedwell therein, said ammunition magazine comprising:

housing means for storing a plurality of ammunition rounds in a generally parallel relationship with one another and the small arm weapons reciprocating bolt; said magazine housing means comprising a pair of end plates with a plurality of sprockets disposed therebetween for supporting a continuous ammunition conveyor strip;

drive spring means for urging said ammunition rounds out of said housing means, said drive spring means decompressing as the ammunition rounds are urged out of said housing means;

feeder means for passing ammunition rounds from the housing means into the ammunition feedwell of a small arm weapon, said feeder means being configured for being removably inserted into the small arm weapon ammunition feedwell, said feeder means having at least one linear feeder spring means for urging ammunition rounds along the feeder means and within the ammunition feedwell of the small arm weapon, said feeder spring means decompressing as the ammunition rounds are moved within the ammunition feedwell, said feeder means including pawl means disposed within a feeder housing for urging ammunition rounds therewithin, said pawl means including a set of stationary pawls and a set of moveable pawls disposed on a pawl carrier, said feeder spring means being operated for moving the pawl carrier and said impact arms means being interconnected with said pawl carrier for compressing the feeder spring means, means, interconnected with both said drive spring means and said feeder spring means, for engaging the reciprocating bolt and causing movement of the reciprocating bolt to compress both the drive spring means and the feeder spring means when the feeder means is inserted into the small arm weapon ammunition feedwell, said means for engaging the reciprocating bolt comprising impact arm means extending outwardly from said feeder housing for engaging said reciprocating bolt, said impact arm being configured and positioned with respect to the reciprocating bolt, when the feeder means is inserted into the small arm weapon ammunition feedwell, for causing engagement of the impact arms with the bolt to drive the impact away from and out of contact with the reciprocating bolt, said impact arm including means defining a slanted face thereon to substantially reduce contact with the bolt face subsequent to initial contact with the bolt face subsequent to initial impact between the impact arm and bolt.

2. The ammunition magazine according to claim 1, wherein the end-plates and the ammunition housing means have the overall shape of a yoke having two branches with a crotch therebetween.

3. The ammunition magazine according to claim 2, wherein said sprockets are disposed within the housing means for supporting the ammunition conveyor strip in a serpentine fashion within the magazine housing means.

4. The ammunition magazine according to claim 3, wherein the ammunition conveyor strip comprises a plastic film having means defining cutouts therein for supporting individual ammunition rounds in a spaced-apart relationship with one another and for moving the ammunition rounds within the magazine housing means.

5. The ammunition magazine according to claim 4, wherein the feeder means is removably attached to the housing means at the crotch thereof and arranged so that the two branches extend toward the small arm weapon when the feeder means is inserted into the small arm weapon ammunition feedwell.

6. The ammunition magazine according to claim 5 wherein the drive spring means comprises a torsinal clock-type spring disposed within said feeder means.

7. The ammunition magazine according to claim 5, wherein the drive spring means includes winder/buffer means for converting linear motion of the pawl carrier into rotary motion.

8. The ammunition magazine according to claim 7, wherein the winder/buffer means is operative for buffering between the relatively high speed acceleration start/stop motion of the pawl carrier and the relatively low speed/acceleration motion of the ammunition conveyor strip.

9. The ammunition magazine according to claim 8 wherein the housing means includes a drive sprocket configured for engagement with said winder/buffer means.

10. The ammunition magazine according to claim 9, wherein the magazine housing means and the continuous ammuition conveyor strip are configured for holding up to about 100 rounds of standard military M-16 ammunition.

11. An ammunition magazine for small arm weapons having a reciprocating bolt and an ammunition feedwell therein, said ammunition magazine comprising:

housing means for storing a plurality of ammunition rounds;

drive spring means for urging said ammunition rounds out of said housing means, said drive spring means decompressing as the ammunition rounds are urged out of said housing means;

feeder means for passing ammunition rounds from the housing means into the ammunition feedwell of a small arm weapon, said feeder means being configured for being removably inserted into the small arm weapon ammunition feedwell, said feeder means having feeder spring means for urging ammunition rounds along the feeder means and within the ammunition feedwell of the small arm weapon, said feeder spring means decompressing as the ammunition rounds are moved within the ammunition feedwell;

means for coupling and uncoupling the feeder means and housing means with one another; and means interconnected with both said drive spring means and said feeder spring means, for engaging the reciprocating bolt and causing movement of the reciprocating bolt to compress both the drive spring means and the feeder spring means when the feeder means is inserted into the small arm weapon ammunition feedwell, and coupled with said housing means.

12. The ammunition magazine according to claim 11 wherein the means for engaging the reciprocating bolt comprises impact arm means extending outwardly from said feeder housing for engaging said reciprocating bolt.

13. The ammunition magazine according to claim 12, wherein said impact arm is configured and positioned with respect to the reciprocating bolt, when the feeder means is inserted into the small arm weapon ammunition feedwell, to cause engagement of the impact arm with the bolt to drive the impact arm away from and out of contact with the reciprocating bolt.

14. The ammunition magazine according to claim 13, wherein said impact arm includes means defining a slanted face thereon to substantially reduce contact with the bolt face subsequent to initial impact between the impact arm and the bolt.

15. The ammunition magazine according to claim 11, wherein the feeder means includes pawl means for urging ammunition rounds along the feeder means.

16. The ammunition magazine according to claim 15, wherein the feeder means includes a feeder housing and the pawl means are disposed within the feeder housing for passing ammunition rounds therethrough.

17. The ammunition magazine according to claim 16, wherein the pawl means includes a set of stationary pawls and a set of movable pawls disposed on a pawl carrier, said feeder spring means is operative for moving the pawl carrier, and said impact arm means is interconnected with said pawl means for compressing the feeder spring means.

18. The ammunition magazine according to claim 17, wherein the feeder spring means comprises at least one linear type spring.

19. The ammunition magazine according to claim 18, wherein the ammunition rounds disposed within the feeder housing and housing means are held in a generally parallel relationship with one another and the small arm weapon reciprocating bolt.

20. The ammunition magazine according to claim 19, wherein said magazine housing means comprises a pair of end-plates with a plurality of sprockets disposed therebetween for supporting a continuous ammunition conveyor strip.

21. The ammunition magazine according to claim 20, wherein the end-plates and the ammunition housing means have the overall shape of a yoke having two branches with a crotch therebetween.

22. The ammunition magazine according to claim 21 wherein said sprockets are disposed within the magazine housing means for supporting the ammunition conveyor strip in a serpentine fashion within the magazine housing means.

23. The ammunition magazine according to claim 22, wherein the ammunition conveyor strip comprises a plastic film having means defining cutouts therein for supporting individual ammunition rounds in a spaced-apart relationship with one another and for moving the ammunition rounds within the magazine housing means.

24. The ammunition magazine according to claim 23 wherein the feeder means is removably attached to the housing means at the crotch thereof and arranged so that the two branches extend toward the small arm weapon when the feeder means is inserted into the small arm weapon ammunition feedwell and coupled to the housing means.

25. The ammunition magazine according to claim 24, wherein the drive spring means includes winder/buffer means for converting linear motion of the pawl carrier into rotary motion.

26. The ammunition magazine according to claim 24, wherein the drive spring comprises a torsinal clock-type spring disposed within said feeder means.

27. The ammunition magazine according to claim 26 wherein the winder buffer means is operative for buffering between the relatively high speed acceleration start/stop motion of the pawl carrier and the relatively low speed/acceleration motion of the ammunition conveyor strip.

28. The ammunition magazine according to claim 27 wherein the housing means includes a drive sprocket configured for engagement with said winder buffer means.

29. An ammunition magazine system for small arm weapons having a feedwell therein, said ammunition magazine system comprising:

a plurality of magazine housings, each magazine housing being adapted for storing a plurality of ammunition rounds, each magazine having means for moving ammunition rounds within said housing and adapted for engaging drive spring means;

feeder means configured for being removably inserted into the ammunition feedwell of a small arm weapon; said feeder means having feeder spring means for urging ammunition rounds along the feeder means and within the ammunition feedwell of the small arm weapon and drive spring means for engaging said means for moving ammunition rounds within said housing; said feeder spring means and said drive spring means decompressing as the ammunition rounds are moved within the ammunition feedwell, said feeder means having means interconnected with both said feeder spring means and said drive spring means for engaging the reciprocating bolt and causing movement of the reciprocating bolt to compress both the feeder spring means and the drive spring means when the feeder means is inserted into the small arm weapon feedwell and coupled to one of said plurality of housing means; and means for removably coupling said feeder means with any one of the plurality of magazine housings.

* * * * *